US005858460A

United States Patent [19]

Ferrando et al.

[11] Patent Number: 5,858,460

[45] Date of Patent: Jan. 12, 1999

[54] METAL MATRICES REINFORCED WITH SILVER COATED BORON CARBIDE PARTICLES

[75] Inventors: William A. Ferrando, Arlington; Amarnath P. Divecha, Falls Church, both of Va.; James Kerr, Bethesda, Md.; Subhash D. Karmarkar, Great Falls, Va.

[73] Assignee: The United States of America as represented by the Secretary of the Navy, Washington, D.C.

[21] Appl. No.: 724,079

[22] Filed: Jul. 1, 1991

[51] Int. Cl.[6] ..... B05D 3/02

[52] U.S. Cl. ..... 427/217; 427/229

[58] Field of Search ..... 427/217, 229

[56] References Cited

U.S. PATENT DOCUMENTS

| | | | |
|---|---|---|---|
| 4,808,780 | 2/1989 | Seaborne | 426/113 X |
| 4,939,079 | 7/1990 | Wolff et al. | 430/558 |
| 4,965,427 | 10/1990 | Seaborne | 219/10.55 E |
| 4,978,054 | 12/1990 | Ferrando et al. | 228/194 |
| 5,019,681 | 5/1991 | Lorence et al. | 219/10.55 E X |

*Primary Examiner*—Peter A. Nelson
*Attorney, Agent, or Firm*—John Forrest; Roger D. Johnson

[57] ABSTRACT

Silver metal-coated boron carbide ($B_4C$) particle reinforce aluminum-lithium alloy or magnesium-lithium matrix composites which are prepared by coating the $B_4C$ particles with molten $AgNO_3$, decomposing the molten $AgNO_3$ to form a coating of silver metal on the $B_4C$ particles, mixing the silver coated $B_4C$ particles into a molten aluminum-lithium alloy or magnesium-lithium alloy matrix, allowing the mixture to cool and solidify the solid composite.

16 Claims, 4 Drawing Sheets

METAL MATRICES REINFORCED WITH SILVER COATED BORON CARBIDE PARTICLES

BACKGROUND OF THE INVENTION

This invention relates to metal matrix composites and more particularly to metal matrixes reinforced with ceramic particles.

There is a relentless search for easily produced, lightweight metallic materials having high strength and toughness. Alloys of magnesium-lithium and aluminum-lithium containing particulate or whisker reinforcement are under consideration for use in aerospace and other critical applications. Although these alloys already are attractive from a weight standpoint, it would be advantageous if their specific strength (modulus) could be improved conveniently by reinforcement. At the same time, it would be further beneficial if the property of elevated temperature superplasticity could be preserved in the composites. Superplasticity is the capability of certain polycrystalline materials to undergo extensive plastic deformation prior to failure. Various Mg/Li and Al/Li alloys possess this property, which is exploited in modern forming methods. A candidate material for particulate reinforcement of these alloys is boron carbide ($B_4C$, density=2.52 g/cc). The problem at hand is how this reinforcement material can be introduced in the fabrication process so as to reside uniformly and with proper interfacial characteristics in the final composition to preserve the desirable physical characteristics of the metal matrix material.

Discontinuous matrix metal composites are normally produced by the powder metallurgy method. Fine powders of the composite components (e.g. metals and reinforcement) in the correct concentration are mixed as thoroughly as possible. Blenders, shakers and liquid media are employed. Almost inevitably, the mixture is poor due to the difference in specific gravity, shape and size of the component particles. Moreover, during the consolidation step of the process, the thin oxidation coating on the metal particles presents a bonding problem. This layer must be broken by high compaction pressure to produce bonding. The hot pressing must be done often in vacuum to obtain good compaction and remove any hydration products which may be present. It, therefore, be highly advantageous if ingot metallurgy casting (IM) could be applied to the fabrication of these composites. In ingot casting, the metallic components, in larger sized pieces, are melted together. The reinforcement material is stirred in thoroughly and the mixture poured into a mold. This is a relatively simple and less costly procedure.

In the case of $B_4C$ reinforcement addition to molten Mg—Li and Al—Li, the problem is twofold. The metals do not readily wet the particles and reaction is possible with too long an exposure at elevated temperature. The former characteristic renders uniform mixing all but impossible. The latter eventually allows reaction phases to form. In particular, the high temperature exposure eventually removes the carbon from the $B_4C$ leaving behind boron which forms solid lumps in the melt due to its very high melting temperature (>2000° C.).

SUMMARY OF THE INVENTION

Accordingly an object of this invention is to provide new, improved metal matrix composites.

Another object of this invention is to provide new, improved $B_4C$ particle reinforced aluminum-lithium alloy metal matrix composites.

A further object of this invention is to provide new, improved $B_4C$ particle reinforced magnesium-lithium alloy metal matrix composites.

Another object of this invention is to provide a new method of making $B_4C$ particle reinforced aluminum-lithium or magnesium-lithium alloy metal matrixes.

These and other objects of this invention are accomplished by providing:

a process for producing $B_4C$ particle reinforce metal matrix composites by 1. coating the $B_4C$ particles with molten $AgNO_3$;
2. decomposing the $AgNO_3$ to deposit a silver metal coating on the $B_4C$ particles;
3. mixing the silver metal coated $B_4C$ particles in to a molten metal alloy which is a aluminum-lithium alloy or a magnesium-lithium alloy; and
4. cooling the $B_4C$/metal alloy mixture to solidify the molten metal alloy and form the solid $B_4C$ particle reinforce metal alloy matrix composite.

The process produces metal matrix composites composed of silver metal-coated $B_4C$ particles suspended in a aluminum-lithium alloy matrix or silver metal-coated $B_4C$ particles suspended in a magnesium-lithium alloy matrix.

Figure 1A:
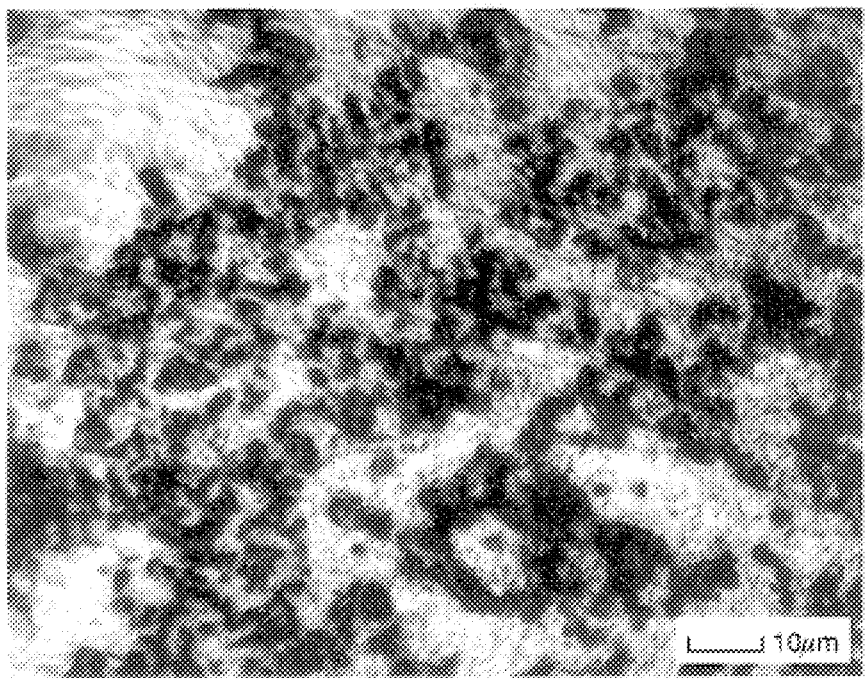
FIGS. 1A and 1B are photographs showing the microstructure of a composite billet produced in example 1 from a magnesium-lithium alloy and silver-coated boron carbide particles.

These figures are further discussed in the examples.

DETAILED DESCRIPTION OF THE PREFERRED EMBODIMENT

The present process provides an improved method of reinforcing aluminum-lithium alloy or magnesium-lithium alloy matrixes with silver metal-coated boron carbide particles ($B_4C$). When conventional uncoated $B_4C$ particles are mixed with molten aluminum-lithium or magnesium-lithium alloys, the particles are slow to wet and the molten alloys attack the $B_4C$, reducing some of it to boron which forms solid lumps. In contrast the silver metal-coated $B_4C$ particles are readily wetted by the molten aluminum-lithium and magnesium-lithium alloys and the silver metal coating protects the $B_4C$ from attack by the molten alloys.

The first phase of the process is to prepare the silver coated $B_4C$ particles. First, the $B_4C$ powder is mixed with the appropriate amount of finely powdered silver nitrate ($AgNO_3$) to produce silver coated $B_4C$ particles having the desired weight percent of silver. Note that 1.575

$$\frac{\text{mol wt } AgNO_3}{\text{Atomic wt Ag}} = \frac{169.9}{107.9} = 1.575$$

grams of $AgNO_3$ are used for every gram of silver needed in the silver metal coated $B_4C$ particle material. The particle sizes of the $B_4C$ powders use are the same as those conventional used to reinforce metal matrices. The $AgNO_3/B_4C$ powder mixture is then heated at a temperature of preferably from just above the melting point to just below the decomposition temperature of $AgNO_3$, and more preferably from 225° C. to 400° C. until the $AgNO_3$ melts. The molten $AgNO_3$ and $B_4C$ particles are further mixed to assure completed coating of the $B_4C$ particles with molten $AgNO_3$. Next the coated particles are heated at a temperature of preferably from the decomposition temperature of $AgNO_3$ to about 850° C., more preferably from 450° C. to 550° C., and still more preferably from 450° C. to 500° C. until the molten $AgNO_3$ coating decomposes to leave a coating of silver metal on the $B_4C$ particles. Finally, the silver metal-coated $B_4C$ powder is ground and screened to separate the silver metal-coated $B_4C$ particles.

As the Ag coating process was applied to various $B_4C$ powders, a varying degree of pyrophoric behavior was noted. The exact nature of the reaction is not known at present. It is most likely due to the present of carbon and the surface energy state of the given powder. $B_4C$ powders which displayed strong reaction with the $AgNO_3$ eventually were rejected due to oxidation of the carbon and dewetting of the Ag caused by the extreme temperature. Compositional analysis of such a powder sample indicated a mixture of boron nitride and boron oxide as well as silver and $B_4C$. By successive trial, $B_4C$ (#500 abrasive powder manufactured by Carborundum Corp., Niagara Falls, N.Y.) was found not to exhibit evident pyrophoric behavior and have the acceptably uniform ag coating results. Other commercial $B_4C$ powders should be carefully tested for pyrophoric reactions with molten $AgNO_3$ before using them in the present process.

The composition of the silver metal-coated $B_4C$ particles is preferably about 10 to about 30, more preferably from 15 to 25, and still more preferably from 18 to 22 weight percent of silver with the remainder of the coated particle being $B_4C$.

Next the silver metal coated $B_4C$ particles are thoroughly mixed with the selected molten aluminum-lithium or magnesium-lithium alloy. These may be done by any of the conventional mixing methods used in ceramic particle/metal matrix composite manufacturing processes. In the examples the silver metal-coated $B_4C$ particles and the molten alloys were mixed by stirring. Ideally, the object is to get an even distribution of silver coated $B_4C$ particles throughout the molten alloy in as short of time as possible.

The silver coated $B_4C$/molten alloy mixture is then pour into suitable molds and cooled to form solid composite shapes.

The alloys used as the matrix material are preferably aluminum-lithium and magnesium-lithium alloys. The aluminum-lithium alloy preferably comprises from 1% to 10%, more preferably from 1% to 5%, and still more preferably from 2.0% to 2.8% weight percent of lithium with the remainder of the alloy being essentially aluminum. Similarly, the magnesium-lithium alloy preferably comprises from about 1% to about 10%, more preferably from 5% to 10%, and still more preferably from 7% to 9% weight percent of lithium with the remainder of the alloy being essentially magnesium.

The silver metal coated $B_4C$ particles may also be used with conventional aluminum alloys such as 8090 aluminum alloy and 2090 aluminum alloy to provide new composites.

The volume percent of silver coated $B_4C$ particles in the composite is comparable to that generally used for ceramic particles in aluminum-lithium and magnesium-lithium alloy matrixes. Preferably from 10% to 30%, more preferably from 15% to 25%, and still more preferably from 18% to 22% volume percent of the composite is silver metal coated $B_4C$ particles with the remainder of the composite being the metal alloy matrix material.

The general nature of the invention having been set forth, the following examples are presented as specific illustrations thereof. It will be understood that this invention is not limited to these specific examples, but is susceptible to various modifications that will be recognized by one of ordinary skill in the art.

Example 1

5 grams of $B_4C$ powder (American Refractories Technology, Inc., North Haven, Conn. 06473) was coated with 20 weight percent Ag by the $AgNO_3$ process. This quantity of $B_4C$ (density=2.52 g/cc) was chosen to provide 10 volume percent of the reinforcement in a small billet of 20 cc. Pyrophoric reaction was noted with this powder during the coating process as noted above. Constituents of the billet were measured such as to provide 10 volume percent Ag coated $B_4C$ in a matrix of 91 volume percent Mg and 9 volume percent Li. This proportion was intended to provide a maximum quantity of dissolved Li in the composite.

Figure 1B:
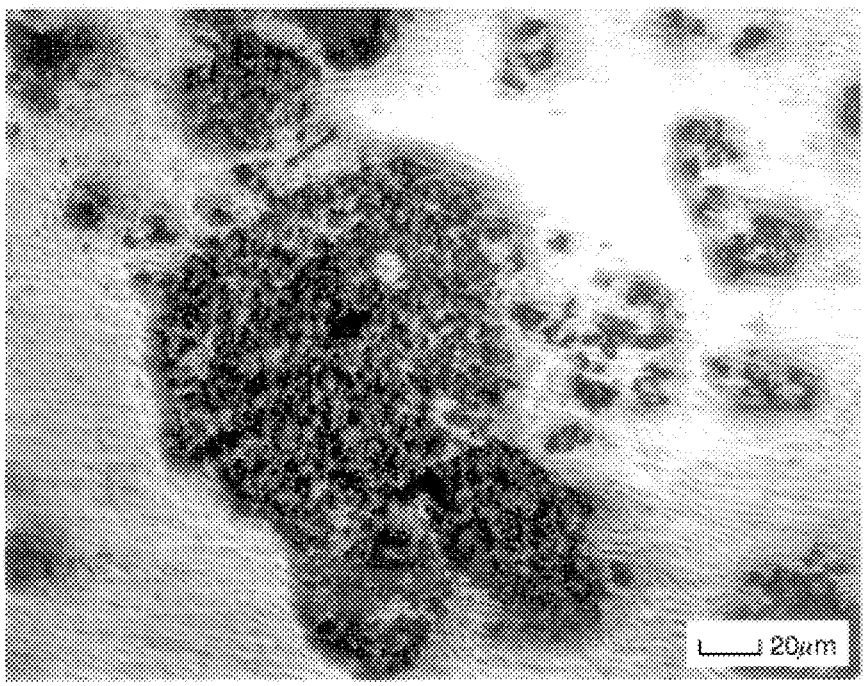

The computed amount of Mg (28.5 g) was added to the silver coated $B_4C$-lithium mixture in increments at increasing temperatures required by the Mg—Li phase diagram sufficient to maintain the alloy in liquid state. (See Mg—Li phase diagram, Hansen, M., "Constitution of Binary Alloys," McGraw-Hill Book Company, N.Y., 2nd edition (1958), P. 897.) The intent was to avoid exposing the reinforcement to high temperature for any longer period than necessary. To accomplish this, the Mg was divided into 9 portions of 3.16 grams each. One each of these was added and mixed at temperatures of: 210°, 235°, 255°, 265°, 310°, 385°, 480°, 575°and 600° C., respectively, in the helium atmosphere glove box. Most of the $B_4C$ was able to be mixed into the melt. The process, however, took some 2 hours which was longer than anticipated. After raising its temperature briefly to about 700° C., the sample was poured into a graphite mold. The texture was uneven, part being fluid and the balance very lumpy. FIG. 1 shows a typical microstructure of this billet. Aggregation of the particles is evident. Individual particles are not easily visible, perhaps indicating a change in their morphology due to oxidation and nitriding during the pyrophoric heating. Another possibility is reaction with the lithium which reduces some $B_4C$ to boron which would tend to form insoluble solid lumps.

Example 2

A second billet was fabricated using corrected constituent quantity measurements and a more expeditious melting procedure. This was a ⅓ size billet 50 cc in volume. This time a quantity of 25 grams of $B_4C$ was coated to 20 weight percent Ag using the $AgNO_3$ process. This provided about 10 cc or 20 volume percent of the 50 cc billet. Proportions of the remaining 40 cc were computed carefully to produce an alloy of 91 weight percent Mg and 9 weight percent Li. 52.5 grams Mg (density=1.74 g/cc) and 5.1 grams Li (density=0.53 g/cc) were used. The Mg and Li were mixed and heated to about 730° C. to thoroughly melt them. The Ag coated $B_4C$ reinforcement was first ground and sieved through 300 mesh to separate the particles. The later then were added to the melt (at 730° C.), about ⅓ part at a time, while stirring (The Carborundum, Inc.) $B_4C$. After adding all the $B_4C$ and stirring, the mixture was reheated and stirred several times. Total residence time of the $B_4C$ at the melt temperature was about one half hour. Somewhat uneven consistency was noted as the composite was poured into the mold. This could have been due to some settling of the reinforcement particles in the melt.

Figure 2A:
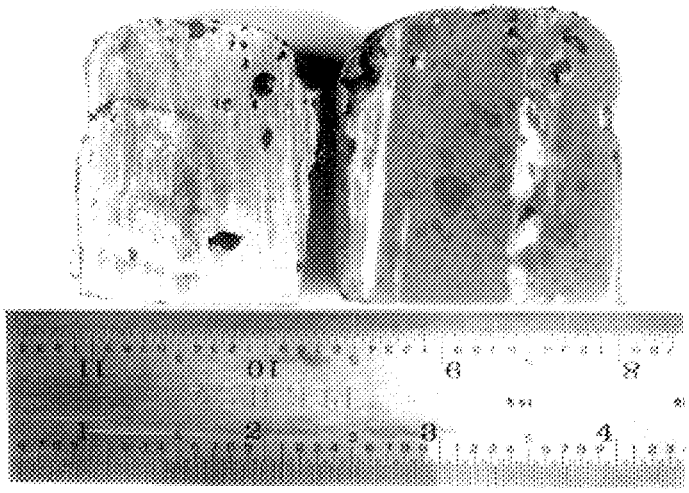
FIG. 2A is a photograph showing a cut composite billet produced in example 2 from a magnesium-lithium alloy and silver coated boron carbide particles.
Figure 2B:
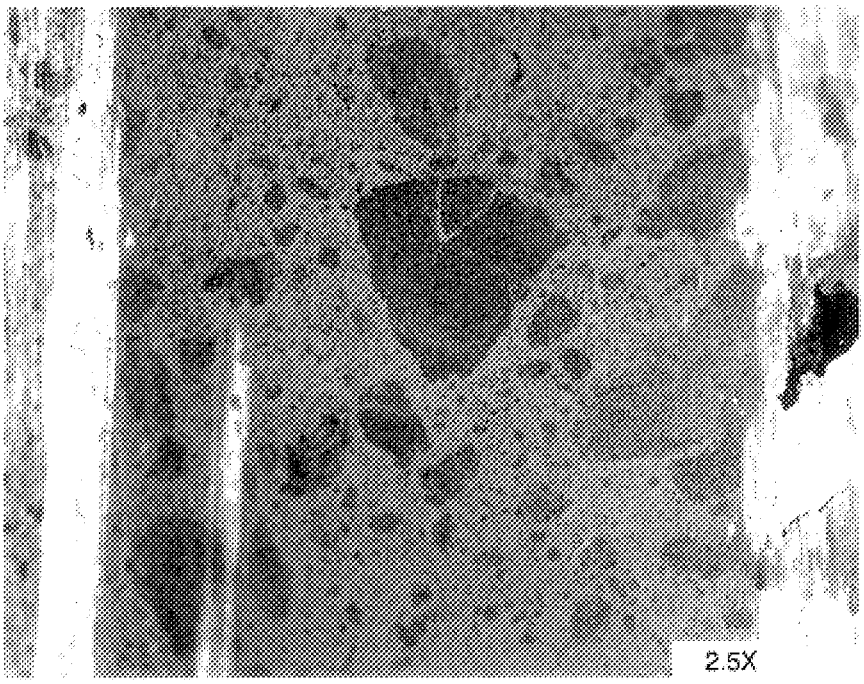
FIG. 2B is a photograph showing the microstructure of the silver coated-boron carbide/magnesium-lithium alloy billet produced in example 2.
Figure 3A:
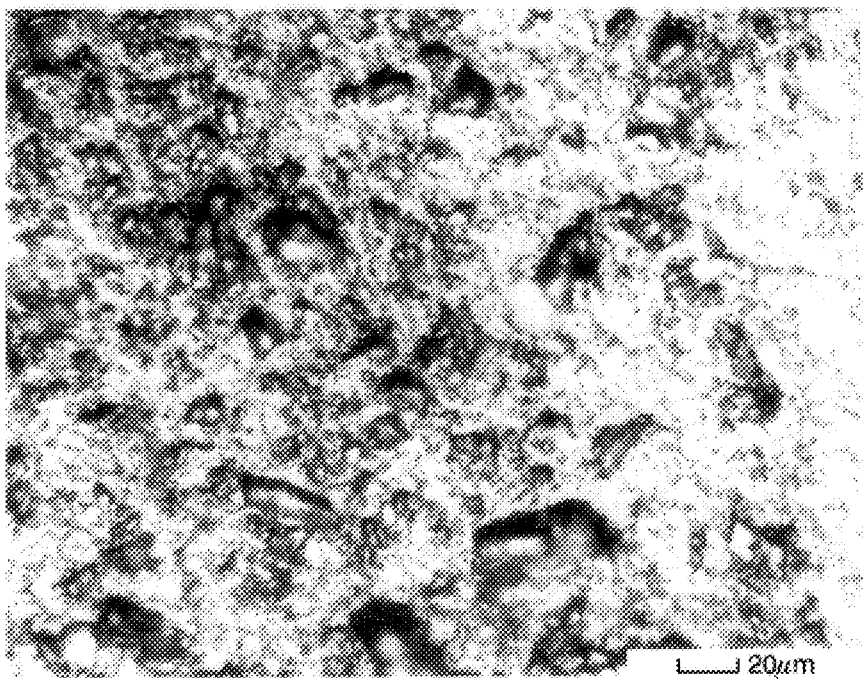
FIG. 3A shows a metallograph picture (400 X) of the microstructure of the silver coated-boron carbide/magnesium-lithium alloy billet produced in example 2.
Figure 3B:
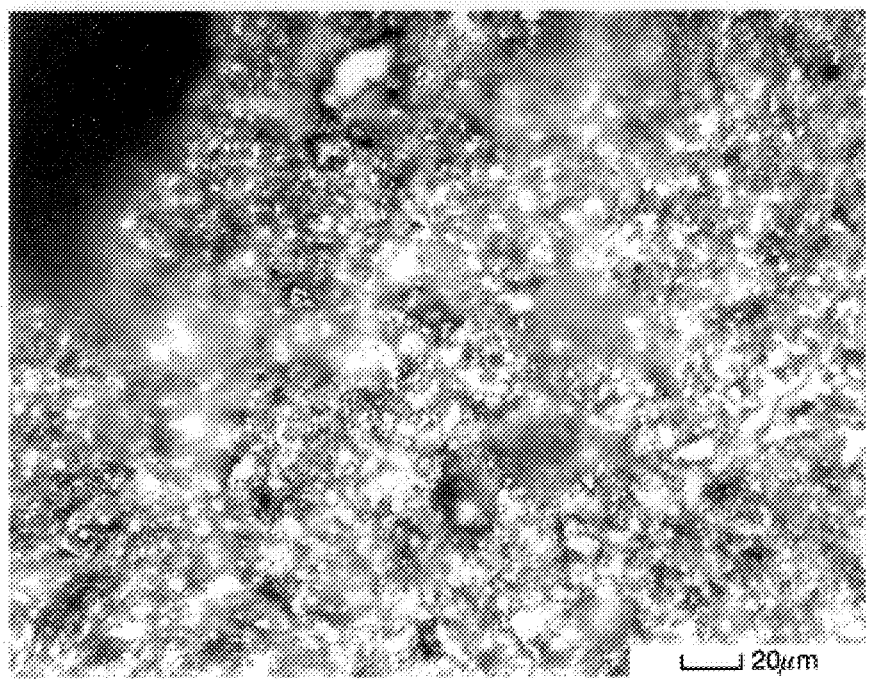
FIG. 3B shows silver metal coated-boron carbide particles mounted in epoxy which were photographed at 400 X and used for comparison with the composite of FIG. 3A.

FIG. 2A shows the cut billet with FIG. 2B showing an enlarged view of its structure. Regions of particle aggregation are evident. FIG. 3 shows a metallograph picture of the billet microstructure at 400 X enlargement. Typical particles of the reinforcement are visible. These particles may be compared with those of a sample of the Ag coated powder mounted in epoxy shown in FIG. 3B as photographed at the same magnification. The size and shape of the particles appear similar, on the average, in the two photographs. This is an indication of a negligible reaction of the particles with the matrix in the course of the heating and mixing.

Example 3

A full size billet was fabricated based upon the experience at this stage. The total billet volume was 146.6 cc. In this case, about 18 volume percent of Ag coated $B_4C$ (Carborundum, Inc.) was used. Computation of the reinforcement volume was as follows: 64 grams of $B_4C$ was coated with 20 weight percent Ag and sieved through 300 mesh. The total powder weight of approx. 77 grams had a volume of about 64/2.52+13/10.5 =26.6 cc. The matrix alloy was computed for a ratio of 91 weight percent Mg to 9 weight percent Li as in examples 1 and 2. Based upon a 120 cc volume, this was 15.3 grams Li and 157.6 grams Mg. The metals were mixed and heated in the glove box to about 730° C. The reinforcement was added about ⅓ portion at a time stirring after each addition. The mix was brought up to temperature and stirred. This step was repeated two more times. After again reaching temperature, the mixture was poured into a split graphite mold. The pouring had to be assisted with a spatula due to the high viscosity of the molten composite. Examination of the melt crucible after pouring revealed that virtually all the $B_4C$ powder had mixed into the Mg—Li alloy.

Figures 4A, 4B, 4C:
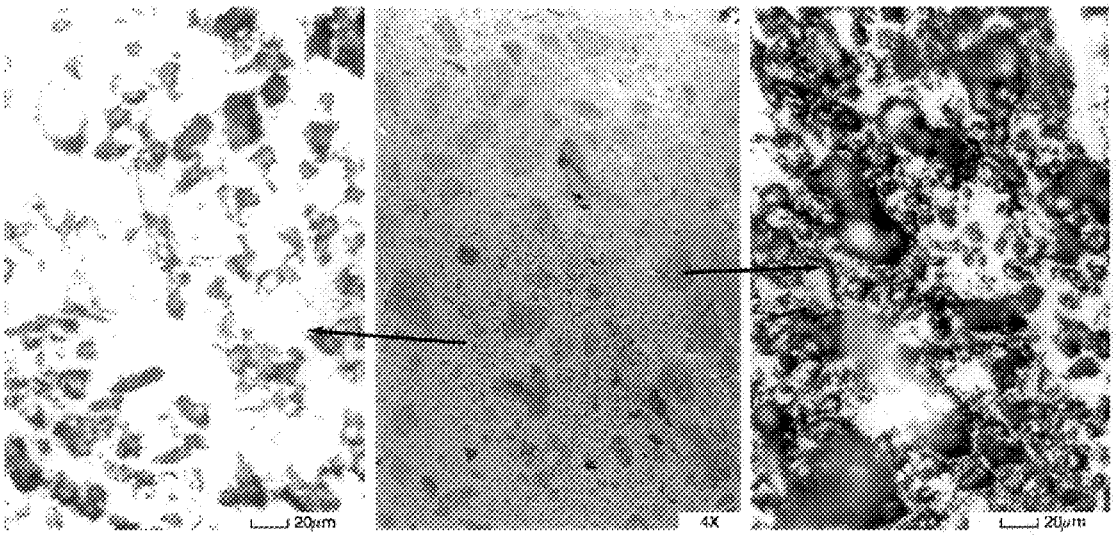
FIG. 4A is a photograph (100 X) showing the microstructure of a composite billet produced in example 3 from a magnesium-lithium alloy and silver metal coated boron carbide with light and dark areas being shown.
FIG. 4B is a photograph (400 X) of one of the light areas of the composite shown in FIG. 4A.
FIG. 4C is a photograph (400 X) of one of the dark areas of the composite shown in FIG. 4A.

FIG. 4A shows a portion of the billet microstructure about 1 inch down from its top. As in example 2, random light and dark regions are readily visible at moderate (100 X) magnification. Higher magnification photographs (400 X) of a lighter region (FIG. 4BV) and a darker region (FIG. 4C) reveal apparently quite similar $B_4C$ particle densities. The darkened features are most likely do to the presence of a mixed phase discussed above in case #2. In each region, individual particles are distinctly visible and apparently well wet by the alloy matrix. The coated $B_4C$ powder has mixed completely into the matrix metal with good wetting and no detectable reaction. Parameters such as degree of stirring and time at temperature may be modified to produce a more uniform texture.

Obviously, numerous modifications and variations of the present invention are possible in light of the foregoing teachings. It is therefore to be understood that within the scope of the appended claims the invention may be practiced otherwise than as specifically described.

What is claimed is:

1. A process for producing a ceramic reinforced metal alloy composite comprising:

A. selecting a $B_4C$ powder which does not react pyrophorically with molten $AgNO_3$;

B. coating the $B_4C$ particles at a temperature from just above the melting point of $AgNO_3$ to less than the decomposition temperature of $AgNO_3$ with an amount of molten $AgNO_3$ that will produce silver metal coated $B_4C$ particles having the desired weight percent of silver metal;

C. heating the molten $AgNO_3$ coated $B_4C$ particles at a temperature of from the decomposition temperature of $AgNO_3$ to about 850° C. until the molten AgNO3 decomposes to form a solid silver metal coating on the $B_4C$ particles;

D. mixing the silver metal coated $B_4C$ particles with a molten alloy which is an aluminum-lithium alloy or a magnesium-lithium alloy; and E. cooling the silver metal-coated $B_4C$ particle/alloy mixture until the solid silver metal coated $B_4C$ particle/alloy composite is formed.

2. The process of claim 1 wherein the temperature used in step B is from 225° C. to 400° C.

3. The process of claim 1 wherein the decomposition temperature used in step C is from 450° C. to 550° C.

4. The process of claim 3 wherein the decomposition temperature used in step C is from 450° C. to 500° C.

5. The process of claim 1 wherein in step B enough molten $AgNO_3$ is used to produce silver metal coated $B_4C$ particles comprising from about 10 to about 30 weight percent of silver metal with the remainder being $B_4C$.

6. The process of claim 5 wherein in step B enough molten $AgNO_3$ is used to produce silver metal coated $B_4C$ particles comprising from 15 to 25 weight percent of silver metal with the remainder being $B_4C$.

7. The process of claim 6 wherein in step B enough molten $AgNO_3$ is used to produce silver metal coated $B_4C$ particles comprising from 18 to 22 weight percent of silver metal with the remainder being $B_4C$.

8. The process of claim 1 wherein the molten alloy used in step D is an aluminum-lithium alloy comprising from about 1 to about 10 weight percent of lithium with the remainder being essentially aluminum.

9. The process of claim 8 wherein the molten alloy used in step D is an aluminum-lithium alloy comprising from 1 to 5 weight percent of lithium with the remainder being essentially aluminum.

10. The process of claim 9 wherein the molten alloy used in step D is an aluminum-lithium alloy comprising from 2.0 to 2.8 weight percent of lithium with the remainder being essentially aluminum.

11. The process of claim 1 wherein the molten alloy used in step D is a magnesium-lithium alloy comprising from about 1 to about 10 weight percent of lithium with the remainder being essentially magnesium.

12. The process of claim 11 wherein the molten alloy used in step D is a magnesium-lithium alloy comprising from 5 to 10 weight percent of lithium with the remainder being essentially magnesium.

13. The process of claim 12 wherein the molten alloy used in step D is a magnesium-lithium alloy comprising from 7 to 9 weight percent of lithium with the remainder being essentially magnesium.

14. The process of claim 1 wherein the amount of $AgNO_3$, $B_4C$ particles, and metal matrix alloy are selected to produce a composite having from about 10 to about 30 volume percent of silver metal coated $B_4C$ particles with the remainder of the composite being essentially the matrix alloy.

15. The process of claim 14 wherein the amount of $AgNO_3$, $B_4C$ particles, and metal matrix alloy are selected to produce a composite having from 15 to 25 volume percent of silver metal coated $B_4C$ particles with the remainder of the composite being essentially the matrix alloy.

16. The process of claim 15 wherein the amount of $AgNO_3$, $B_4C$ particles, and metal matrix alloy are selected to produce a composite having from 18 to 22 volume percent of silver metal coated $B_4C$ particles with the remainder of the composite being essentially the matrix alloy.

* * * * *